United States Patent [19]

Throckmorton et al.

[11] 4,068,120

[45] Jan. 10, 1978

[54] LAMP SHADE STRUCTURE AND METHOD FOR ASSEMBLING SAME

[76] Inventors: Elbert S. Throckmorton; Norajane R. Throckmorton, both of P.O. Box 813, Sumter, S.C. 29150

[21] Appl. No.: 734,966

[22] Filed: Oct. 22, 1976

[51] Int. Cl.[2] ..... F21V 1/22

[52] U.S. Cl. ..... 362/351; 428/41

[58] Field of Search ..... 240/108 R, 108 A, 108 B, 240/110; 428/41, 58

[56] References Cited

U.S. PATENT DOCUMENTS

| | | | |
|---|---|---|---|
| 1,580,922 | 4/1926 | Scherer | 240/108 R |
| 1,585,379 | 5/1926 | Dixon | 240/108 R |

FOREIGN PATENT DOCUMENTS

| | | | |
|---|---|---|---|
| 43,830 | 11/1908 | Switzerland | 240/109 |

*Primary Examiner*—William H. Beha, Jr.

*Attorney, Agent, or Firm*—Birch, Stewart, Kolasch & Birch

[57] ABSTRACT

A lamp shade structure is provided with a wire frame having a polystyrene wrap chemically welded thereon with an obverse surface comprising contact adhesive covered by discrete panels of peel-away protective paper. Corresponding discrete panels of decorative material, such as needlework decorated fabric, are substituted for the peel-away paper panels and the seams between adjacent panels masked by coterminously glued material strips such as grosgrain ribbon coated with clear drying adhesive. Top and bottom peripheral bands are folded over the end frames and form top and bottom borders on the obverse face of the decorated panels to hide the ends of the coterminous seam covering strips and provide a finished lamp structure.

16 Claims, 6 Drawing Figures

LAMP SHADE STRUCTURE AND METHOD FOR ASSEMBLING SAME

FIELD OF THE INVENTION

This invention relates to lamp shades and more particularly to a lamp shade structure having decorative panels adhered thereto and the method for adhering these panels to the base structure of the lamp shade.

BACKGROUND OF THE INVENTION

The present invention provides a lamp shade structure which is particularly well adapted to the fabrication of fabric covered lamp shades in which such decorative patterns as those achieved by needlework and the like may be readily applied to cover the shade. Prior shade covering techniques required continuous wraps of fabric overlying a shade frame, complex stitching and binding which pose many problems for the home craftman whose talents most likely lie in the ability to generate decorative patterns on fabric and not in the art of constructing lamp shades.

Accordingly, there is a need in the market place for a basic lamp shade structure and method of manufacturing same which will permit hobbyists and needlecraft buffs to produce esthetically acceptable and highly decorative lamp shades without having any prior or special knowledge with regard to their manufacture.

Accordingly, it is a primary object of the present invention to provide a new and novel lamp shade structure and method of assembling same.

It is another object of the present invention to provide a self-adhering base covering and frame for lamp shade structures which are adapted to receive finished decorative panels and adhere them to areas on the obverse surface of the lamp shade by means of contact adhesive.

Still another object of the present invention is to provide a lamp shade structure having a polystyrene plastic sheet chemically welded to the frame with a contact adhesive layer on the obverse surface of the plastic sheet with selectively removable panel sections thereon to receive correspondingly shaped panel sections of decorative fabric, needlecraft, and the like on the adhesive surface.

Yet another object of this invention is to provide a new and novel lamp shade structure which includes ribbon bindings and trim on a plastic base on a wire shade frame in which no stitching is required to fully and completely assemble the lamp shade structure.

These and other objects of the present invention will become more fully apparent with reference to the following specification and drawings which relate to a preferred embodiment of the present invention.

SUMMARY OF THE INVENTION

The lamp shade structure of the present invention utilizes conventional peach basket type wire frames which include a top peripheral wire, a bottom peripheral wire, a mounting spider for receiving the mounting post of a lamp and vertical or vertically extending struts between the top peripheral frame and the bottom peripheral frame.

Over this basic frame which may be of a rounded peach basket shape, a cut-corner square shape, or a hexagonal shape, etc., as is well known in the trade, is wrapped a polystyrene sheet in a single lap having a single seam with the top and bottom of the polystyrene sheet trimmed to fit the dimensions of the shade frame. The single lap seam is effected by placing on the polystyrene sheet a complete layer of contact adhesive such that when the overlap is made, the sheet of polystyrene is self-adhering to itself and requires no other fastening or stitching but can be enhanced with an addition of glue, solvent or heat to maintain it in a basically conical, cut-corner or hexagonal configuration with a side seam.

Of course, the polystyrene sheet on its obverse surface is covered with a removable non-adherent paper layer or the like to preclude the adhesive layer from becoming contaminated or otherwise adulterated. This protective paper layer is placed upon the shade in predetermined sectional shapes such as trapezoidal or frusto conical panels such that the entire obverse surface of the polystyrene sheet on the shade frame can be decorated by the application of correspondingly shaped panels of decorative material such as those upon which needlework has been performed. The paper panels are removed merely by grasping one corner thereof and peeling them away from the polystyrene sheet to expose the contact adhesive surface in the desired configuration to receive a decorative panel.

The single lapped side seam in the polystyrene sheet is preferably placed to substantially coincide with one of the vertically extending struts to provide strength and to hide the effect of the seam in the shade such that it is not visible anywhere but in conjunction with the shadow which might be cast by the vertical strut due to light passing through the shade.

The seams between adjacent decorative panels are covered in the finished product by strips of grosgrain ribbon or the like which have been coated on one side with clear drying adhesive such as those which are now on the market and which provide adherence between fabrics, wood, metal, etc., namely, all purpose adhesives. This ribbon strip is secured by the glue from the top peripheral border of the frame to the bottom peripheral border of the frame coterminous with the seam between each of the adjacent panel pairs.

The assembly of the lamp shade is completed by utilizing a wider strip of ribbon material, such as the grosgrain ribbon, coated on one side with all purpose clear drying adhesive, which ribbon is wrapped completely around the upper and lower peripheral end frame members to form a border overlying the tips of the side seam covering ribbons and each of the ribbons forming the said borders having overlying or overlapping end portions on the order of $\frac{3}{8}$–$\frac{1}{2}$ inch of material which has been doubled back under and has been glued upon itself at the juncture of the side of one of the vertical ribbons with the underlying peripherally wrapped ribbon.

This gives a finished appearance to the final seams in the shade, namely, those seams which are produced in the peripherally or circumferentially disposed ribbon bindings at the top and bottom of the lamp shade.

Thus, it can readily been seen that the entire lamp shade of the present invention has been constructed solely with the use of contact adhesive and readily available all purpose cement, preferably a clear drying variety, and without the use of any stitching or other difficult seaming processes whatsoever. Furthermore, the decorative material placed upon the shade is in the form of small or sectional panels which can be placed upon the contact adhesive surface of the underlying plastic base layer on the shade in a very facile manner such that the final application of the ultimate decoration to the shade need not be done in a long continuous strip which is difficult to handle and align on the shade structure.

BRIEF DESCRIPTION OF THE DRAWINGS

FIG. 4 is a partial view of FIG. 3 with the decorative panels fully applied and illustrating the covering of the seam between adjacent panels by a piece of ribbon or the like;

DETAILED DESCRIPTION OF THE DRAWINGS

Figure 1:
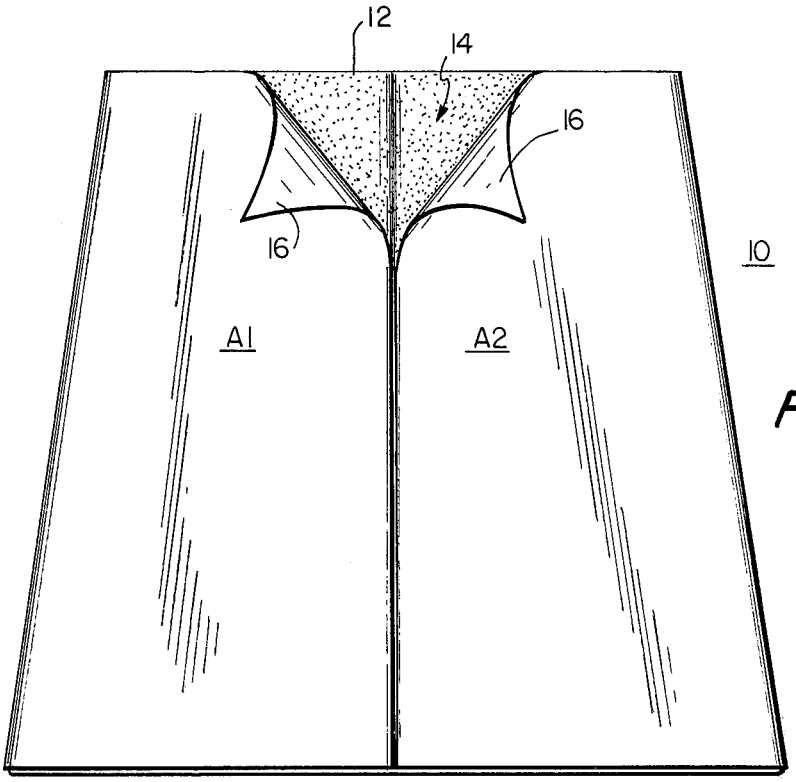
FIG. 1 is a side elevation of a partially constructed lamp shade of the present invention illustrating a protective covering thereon partially peeled away.
Figure 2:
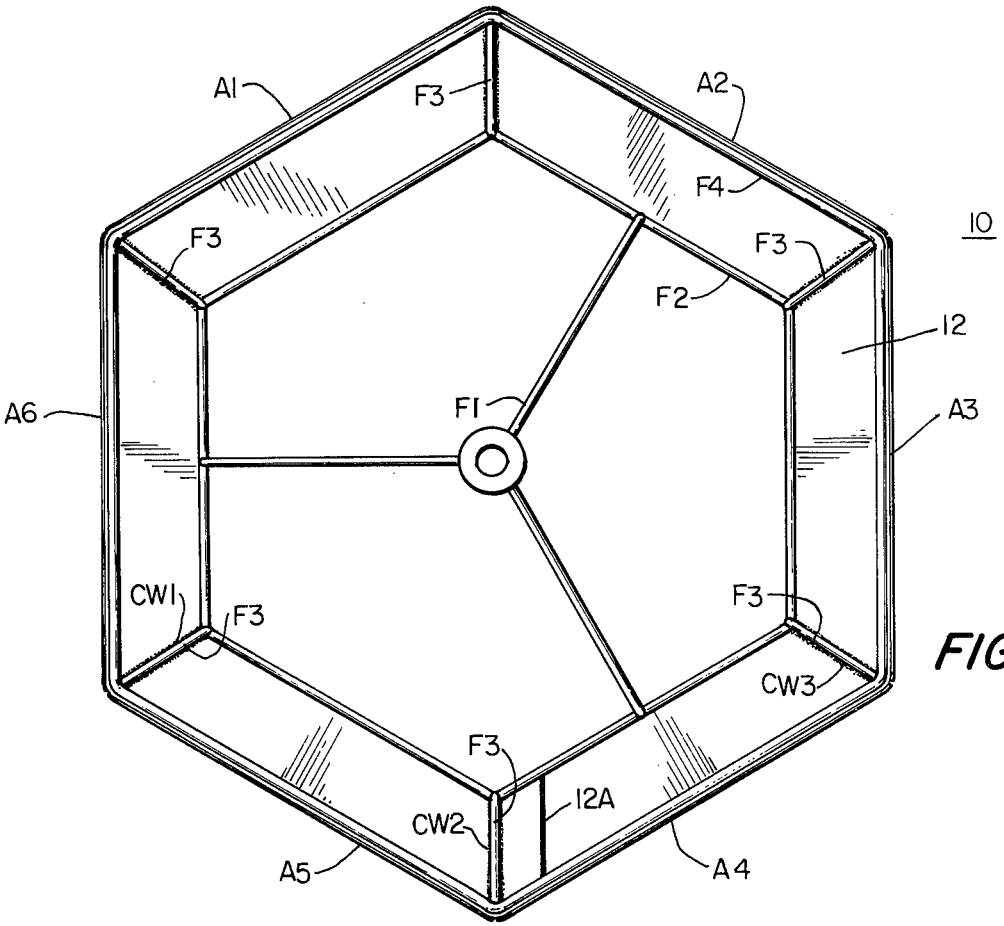
FIG. 2 is a bottom plan view of the partially constructed lamp shade of FIG. 1 illustrating the peach basket type frame of the lamp shade of the present invention.

Referring to FIGS. 1 and 2 of the drawings, the lamp shade 10 of the present invention is shown in a partially constructed form as initially comprising a wiring frame having a mounting spider F1 mounted to a peripherally disposed top band F2 which is hexagonal in plan view which is joined by substantially vertically disposed struts F3 to a bottom peripheral band F4 which is compatibly shaped with the top peripheral band F2. A sheet of flexible plastic material 12 which is composed of, for example, polystyrene sheet having a 14 mil thickness, is coated on its obverse face with a contact adhesive layer generally indicated by the arrow 14 in FIG. 1 and the stripped indication in that figure. Over the obverse layer of contact adhesive 14 are a plurality of peelable paper or other suitable flexible sections 16 which are basically weakly or substantially non-adherent to the adhesive layer 14 and which are shaped to define discrete areas such as A1 and A2 illustrated in FIG. 1. These discrete areas are basically trapazoidal in shape in a hexagonal lamp or frusto conical in shape in a conical lamp, etc.

Extremities of the peelable discrete sections A1, A2, etc. shown in FIG. 2 as being areas A1–A6 defined at their top and bottom ends by the peripheral bands F2 and F4 of the frame of the lamp shade 10 and are bounded on the sides thereof by the substantially vertically disposed struts F3 which define seaming areas between adjacent peelable sections A1–A6.

The polystyrene sheet 12 is overlapped upon itself in the provision of a self-adherent lapped side seam 12A having one edge thereof substantially coincident with one of the substantially vertically disposed struts F3 such that the shadow effect of the side seam 12A is mitigated.

The lapped and seamed polystyrene sheet 12 is trimmed at the top and bottom such that it conforms to the shape and dimensions of the top and bottom peripheral bands F2 and F4 of the frame of the lamp shade 10 and then the internal surface of the polystyrene sheet 12 is painted or coated coterminously and adjacent to each of the substantially vertically disposed struts F3, with a solvent such as acetone or an acetone based solvent for the polystyrene sheet, or other appropriate solvent as the case may be. This solvent causes the plastic sheet 12 to chemically weld to the surface of the vertically disposed struts F3 in the provision of a series of chemical welds generally illustrated in FIG. 2 by the shaded areas CW1, CW2 and CW3.

Figure 3:
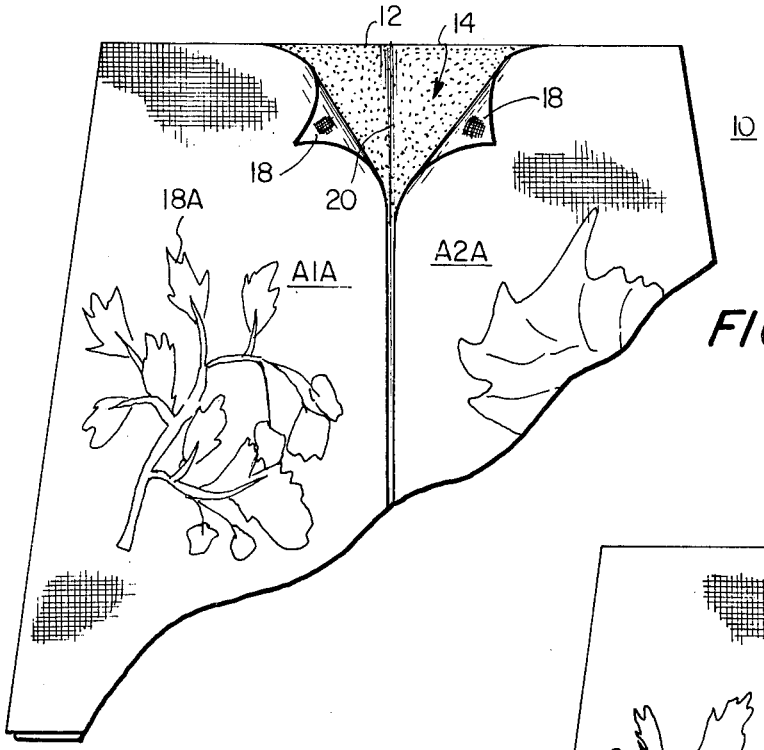
FIG. 3 is a partial side elevation illustrating panels of decorative material applied to the lamp shade of FIG. 1 with the protective panels of FIG. 1 peeled away and replaced thereby.
Figure 4:
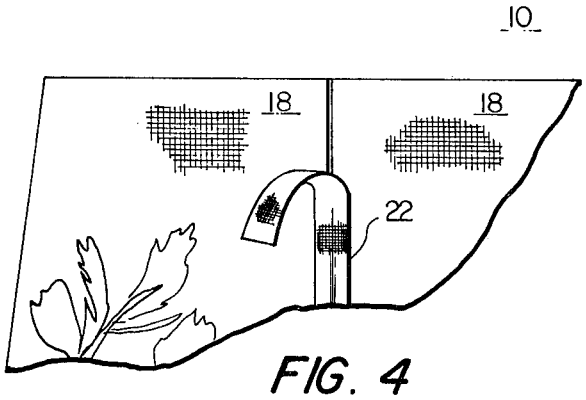

Referring now to FIGS. 3 and 4, the next step in the construction of the lamp shade 10 of the present invention is achieved by removing the protective paper 16 from the areas A1 and A2 and replacing them with panels 18 of decorated fabric or the like such as fabric panels decorated with needlework flowers 18A cut to corresponding discrete shapes A1A and A2A such that A1A is substituted for the removed paper layer 16 in the area A1 and adhered to the contact adhesive 14 and A2A is substituted for the discrete area A2 of paper 16 which has been removed from the shade 10 and is adhered to the underlying contact adhesive layer 14 beneath that particular layer. This procedure is repeated around the entire periphery of the lamp shade 10 until such time as the entire obverse surface of the polystyrene flexible sheet 12 has been covered with panels 18 of decorative material.

As illustrated in FIGS. 3 and 4, in between adjacent panel pairs there are vertical seams or joints 20 which extend substantially coincidentially and coterminously with the vertically disposed strut F3 from the top of the lamp shade to the bottom in the preferred embodiments of the present invention.

Figure 5:
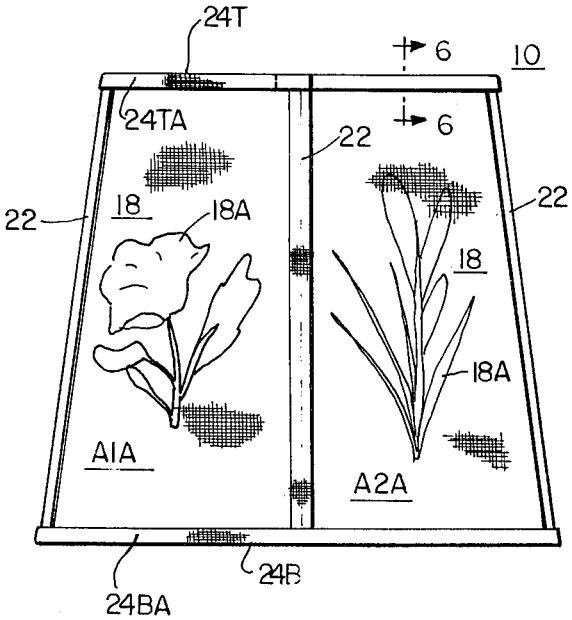
FIG. 5 is a side elevation of a finished lamp shade of the present invention.

In order to mask these seams 20 and make them more esthetically acceptable such that the ultimate construction of the lamp shade 10 as shown in FIG. 5 is not readily apparent to the eye but appears to be a continuous fabric shade or the like, discrete lengths of ribbon 22, such as for example grosgrain ribbon are cut to the length of the vertical seams 20 in the shade 10, the ribbons 22 are saturated or coated on one side with a suitable adhesive such as the universal synthetic adhesives readily available and preferably of a clear drying nature, and then the adhesively coated or saturated ribbon 22 are placed over the seams and adhered to the underlying decorative sections 18 as clearly illustrated in FIG. 4 to mask the side seams in the shade in a manner ultimately illustrated in FIG. 5.

This leaves the top and bottom bands of the shade 10 to be covered and masked in order to complete the structure of the lamp shade 10 with a finished appearance. This masking of the top and bottom bands is achieved with the use of banding ribbon 24T and 24B around the top and bottom bands, respectively, with the top band F2 and its relationship to the banding ribbon 24T clearly illustrated in cross-section in FIG. 6 to which reference is now made. The top peripheral band F2 is covered over by the banding ribbon 24T which has been cut to a length sufficient to go completely around the band F2 and the plastic sheet 12 and its overlapping laminate A1A, A2A etc. completely around the periphery of the lamp shade 10, and then of sufficient additional length to overlap itself as shown at 24TA in FIG. 5. In fact, sufficient length is provided such that at the point 24TA the still free end of the ribbon is doubled back beneath itself to provide a finished appearance and it is adhered to the portion of the ribbon 24T beneath it in the provision of a 3-layer junction which is coincident with intersection of the ribbon 24T with one of the side seams covering ribbons 22 to provide the most finished appearance for the shade 10. By the same token, a similar overlapped appearance is provided along the same vertical seam covering 22 on the bottom ribbon 24B at the point 24A as illustrated in FIG. 5 to provide a more finished and symmetrical lamp shade 10.

Figure 6:
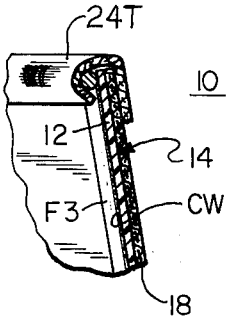
FIG. 6 is a cross-section in enlarged detail taken along line 6—6 of FIG. 5 and illustrating the ultimate laminated construction of the lamp shade of the present invention.

The top and bottom ribbon bands 24T and 24B are impregnated or coated with the same type of adhesive utilized to cover or coat the ribbons 22 along the side seams 20 and are adhered to the obverse surface of the fabric or decorated panels 18 in the provision of a suitable border at the top and bottom of the lamp shade 10 and are folded over and around the upper and lower bands F2 and F4 in the manner illustrated for the band F2 and the ribbon 24T in FIG. 6. Also illustrated in FIG. 6 is a vertical strut F3 the internal surface of the plastic base layer 12 a chemical weld CW the adhesive layer 14 a fabric layer 18 and the edge of a seam covering ribbon 22.

The thickness of the polystyrene sheet of other flexible plastic material is chosen such that a certain amount of tangible stiffness is present between the vertically disposed strut F3 such that the material sections 18 may be manageably adhered without destroying the base layer 12.

The discrete sections A1–A6 of peelable paper 16 may be utilized as patterns to form the discrete panels A1A, A2A, etc. of the decorative materials 18. Alternatively, and preferably, in a kit configuration of the present invention, these patterns are provided by additional sections A1–A6 of paper 16 not adhered to the plastic layer 12.

As can be readily seen from the foregoing specification and drawings, this invention provides a new and novel and facile approach to the manufacture of lamp shades with a plurality of original designs thereon all of which can be made by the home craftsman or hobbyist. There is no prerequisite that anyone utilizing the present invention have previous knowledge or experience in the manufacture of lamp shades. The technique is merely one of removing a discretely shaped protective panel and replacing it with a like discretely shaped decorated fabric panel or other material panel upon which such decorations as needlework or merely textured surfaces may be affixed or imposed to provide numerous variations and patterns for distinctive lamp shades which may be made to perfection by the home craftsman.

It should be understood that the lamp shade structure of the present invention may be modified as would occur to one of ordinary skill in the art without departing from the spirit and scope of the present invention.

It is claimed:

1. A lamp shade construction comprising:

a frame having a top peripheral band, a bottom peripheral band and vertically oriented strut members extending between said bands in a predetermined shade configuration;

a sheet of flexible base material wrapped coterminously about said frame having a single lapped side seam therein;

said base material having its obverse face coated with a contact adhesive layer to provide a self-adhering side seam;

said vertically oriented strut members defining a plurality of discrete obverse surface panels therebetween;

a like plurality of conformally shaped discrete applied panels of decorative material adhered to said surface panels by said contact adhesive, adjacent pairs of said applied panels defining vertically oriented seams;

elongated seaming ribbon means adhesively secured to said applied panels coterminous with and overlying said seams to mask the latter; and elongated border ribbon means extending around the top and bottom periphery of said shade forming top and bottom borders on said obverse surface and overlying said peripheral bands to mask the latter;

said border ribbon means being adhesively secured to said shade.

2. The invention defined in claim 1, wherein said sheet of flexible base material is adhered on its interior surface to said struts.

3. The invention defined in claim 1, wherein said single lapped side seam is substantially coincident and coterminous with one of said struts.

4. The invention defined in claim 1, wherein said sheet of flexible base material is adhered on its interior surface to said struts; and wherein said single lapped side seam is substantially coincident and coterminous with one of said struts.

5. The invention defined in claim 1, wherein said flexible base material is polystyrene.

6. A blank for constructing decorated lamp shades comprising:

a frame having a top peripheral band, a bottom peripheral band and vertically oriented strut members extending between said bands in a predetermined lamp shade configuration;

a sheet of flexible base material wrapped coterminously about said frame and having a single lapped side seam therein;

said base material having substantially is entire obverse face coated with a contact adhesive layer to provide a self-adhering side seam;

said vertically oriented strut members defining a plurality of discrete obverse surface panels therebetween;

a like plurality of conformally shaped discrete applied panels of peelable protective material adhered to said surface panels by said contact adhesive;

said peelable panels being selectively removable to expose a discrete obverse panel of contact adhesive for receiving conformally shaped panels of decorative material.

7. The invention defined in claim 6, wherein said sheet of flexible base material is adhered on its interior surface to said struts.

8. The invention defined in claim 6, wherein said single lapped side seam is substantially coincident and coterminous with one of said struts.

9. The invention defined in claim 6, wherein said sheet of flexible base material is adhered on its interior surface to said struts; and wherein said single lapped side seam is substantially coincident and coterminous with one of said struts.

10. The invention defined in claim 6, wherein said flexible base material is polystyrene.

11. The method of constructing a lamp shade from a plurality of discrete decorative surface panels overlying a sheet material substrate on a wire shade frame comprising:

covering a wire lamp shade frame having a top and bottom band and connecting struts therebetween with a single sheet of flexible base material juxtaposed with said struts and coated on its obverse face with contact adhesive;

overlapping said sheet on itself along one of said struts to form a self-adherent lapped side seam;

applying adhesive means to the inner surface of said sheet coterminously with said struts to adhere said sheet thereto;

trimming said sheet to conform to the top and bottom configurations of said frame;

said obverse surface of said sheet being covered with a peelable protective layer in discrete removable sections;

removing said peelable layer one discrete section at a time to selectively expose said contact adhesive;

applying conformally shaped discrete sections of decorative material to said exposed contact adhesive section by section until the entire obverse surface has been covered thereby with seams extending between adjacent discrete sections;

providing ribbon material the length of said seams;

applying adhesive to said ribbon material;

covering said seams by overlying said seams with said ribbon material and adhering said ribbon material to said adjacent decorative sections;

providing strip material of sufficient length to peripherally border the top and bottom of said shade;

applying adhesive to said strip material; and adhering said strip material to the top and bottom edges of the obverse surface of the shade and folding said strip material inward to cover said top and bottom bands to mask the latter and the exposed ends of any ribbon material adjacent said bands.

12. The invention defined in claim 1, wherein said flexible base material is plastic; and wherein said plastic is chemically welded on its interior surface to said struts.

13. The invention defined in claim 12, wherein said plastic is polystyrene.

14. The invention defined in claim 6, wherein said flexible base material is plastic; and wherein said plastic is chemically welded on its interior surface to said struts.

15. The invention defined in claim 14, wherein said plastic is polystyrene.

16. The method of claim 11, wherein said base material comprises plastic; and wherein said adhesive means comprises a solvent applied to said base material to chemically weld the latter to said struts.

* * * * *